US005273454A

United States Patent [19]

Shotey

[11] Patent Number: 5,273,454

[45] Date of Patent: Dec. 28, 1993

[54] SHROUD WITH TIES FOR INLINE PLUG

[76] Inventor: Michael J. Shotey, 7733 E. Cypress, Scottsdale, Ariz. 85257

[21] Appl. No.: 962,606

[22] Filed: Oct. 16, 1992

Related U.S. Application Data

[63] Continuation-in-part of Ser. No. 729,077, Jul. 12, 1991, abandoned, which is a continuation-in-part of Ser. No. 569,781, Oct. 12, 1990, Pat. No. 5,147,216.

[51] Int. Cl.[5] ..... H01R 13/52

[52] U.S. Cl. ..... 439/367; 439/521; 439/892; 439/369; 174/138 F

[58] Field of Search ..... 439/367, 369, 371, 521, 439/892; 174/138 F

[56] References Cited

U.S. PATENT DOCUMENTS

| | | | |
|---|---|---|---|
| 3,209,061 | 9/1965 | Mier et al. | 174/138 F |
| 4,869,683 | 9/1989 | Nelson | 439/367 |
| 4,944,685 | 7/1990 | Schulte | 439/367 |
| 5,041,000 | 8/1991 | Shotey | 439/367 |

*Primary Examiner*—Paula A. Bradley

[57] ABSTRACT

A flexible water resistant cylindrical sheath encircles an in-line electrical connector to protect it against liquid and particulate contaminants which might create an electrical hazard. Opposed ends of the sheath are closed about respective electrical conductors extending from the in-line connector to enclose the in-line connector. A shroud having flapped ends and of abrasion resistant material envelopes the sheath to protect the sheath and enclosed electrical connector against abrasion.

23 Claims, 2 Drawing Sheets

FIG. 1
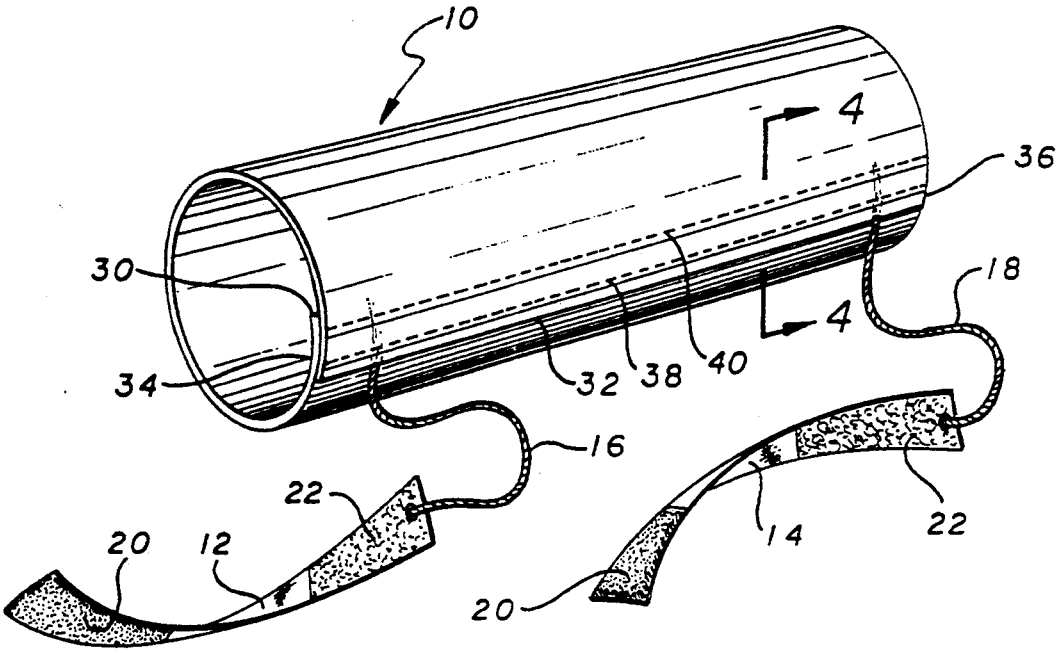
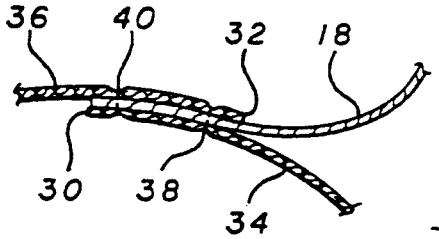
FIG. 4
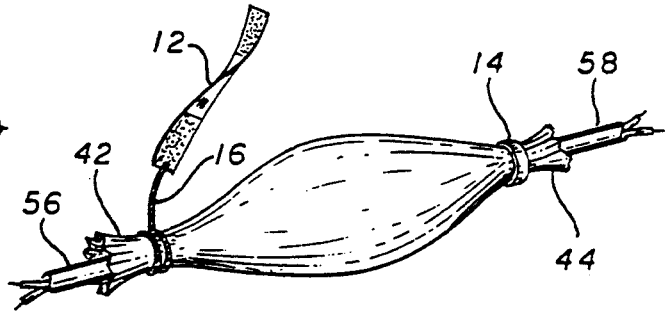
FIG. 2
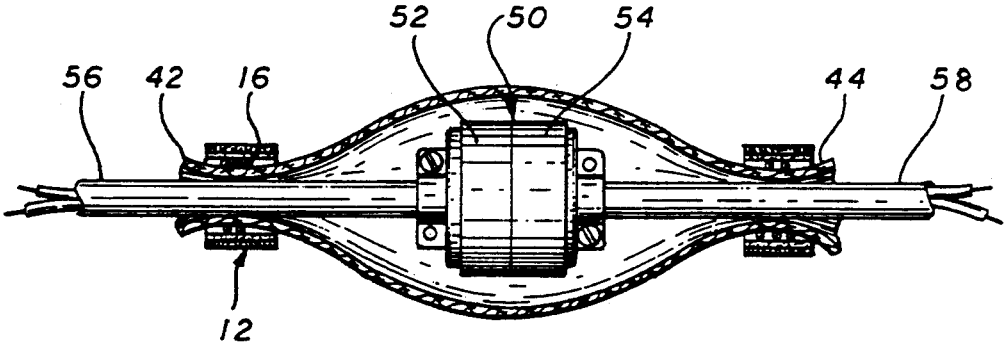
FIG. 3

FIG. 5
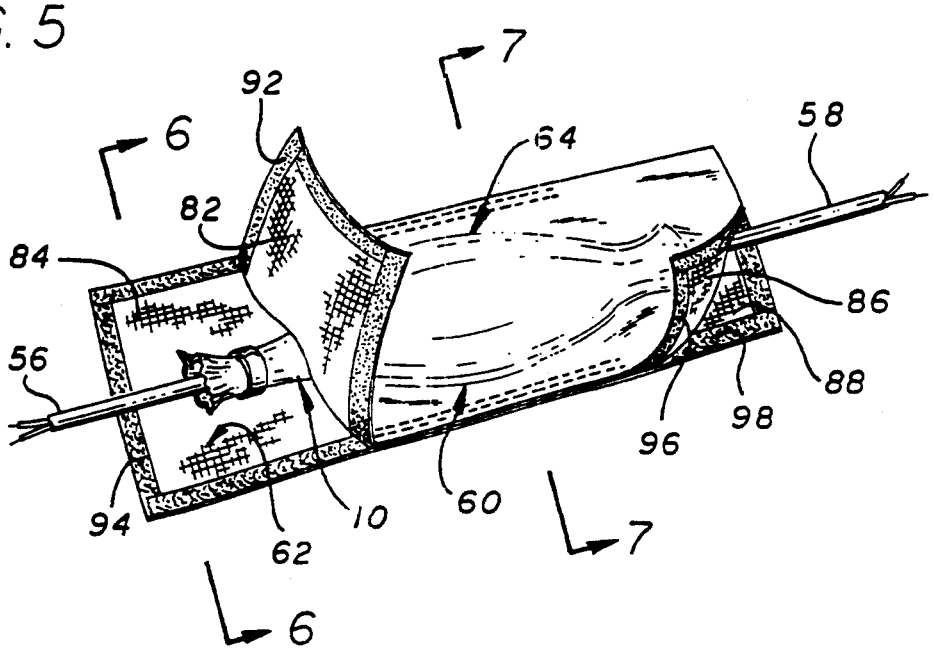
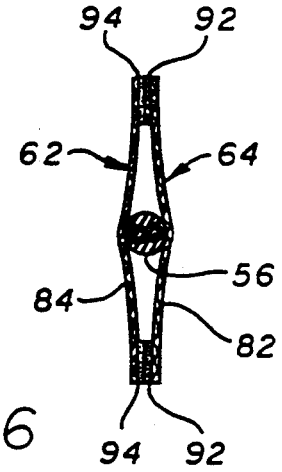
FIG. 6
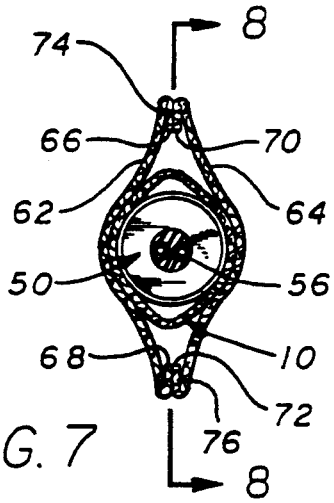
FIG. 7
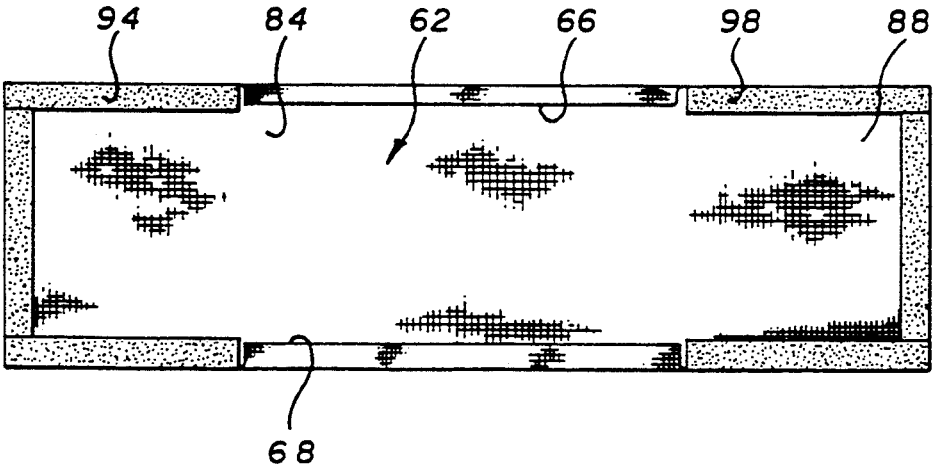
FIG. 8

SHROUD WITH TIES FOR INLINE PLUG

CROSS REFERENCE TO RELATED APPLICATIONS

This is a continuation-in-part of application Ser. No. 07/729,077 filed Jul. 12, 1991, abandoned; which is a continuation-in-part of application Ser. No. 07/596,781 filed Oct. 12, 1990, issued as U.S. Pat. No. 5,147,216 on Sep. 16, 1992.

BACKGROUND OF THE INVENTION

Field of the Invention

The present invention relates to devices for protecting against electrical hazards and, more particularly, to a shroud for enclosing an in-line electrical plug and socket.

Description of Related Art

Extension cords are used both domestically and commercially to provide electric power at a location remote from an electrical wall socket or similar source of electrical power. The electrical plug and mating socket at the terminal end of an electrical extension cord usually lies upon the ground. If there are puddles in the area proximate the electrical plug and socket, an obvious safety hazard would be presented were the electrical plug and socket drawn to or fall into the puddle. Similarly, a rain shower could wet an exposed electrical plug and socket to a degree sufficient to pose a hazard. Where a plurality of electrical extension cords are attached serially, each electrical plug and socket unit presents a potential hazard.

Partial disengagement of an electrical plug and socket will expose the prongs of the plug even though they may still be electrically connected to the socket. Such exposure increases the potential hazard in that access is provided for numerous types of electrical conducting elements to come into contact with the electrically charged prongs. Such contact poses yet further hazards.

Enclosures for plugged in plugs are often placed upon rough or abrasive surfaces. Such surfaces rapidly abrade and damage an enclosure after even a limited period of use. Any rips, holes, splits or tears eliminate the protection provided by the enclosure due to intrusion of liquid or particulate contaminants. Thus, the enclosure should be abrasion resistent.

To render such enclosures useful and used, they should be capable of being conveyed to a work site in a toolbox or similar equipment container normally transported to the work site. Because space is at a premium in any such container, the enclosure should be of small size during storage and transportation and preferably should be adaptable to whatever space is available in the container.

Various devices have been developed for enclosing an electrical plug with a mated socket. Such devices are of rigid construction to physically protect the plug and socket unit. Some of these devices include elaborate sealing elements for precluding inflow of water. Numerous devices have also been developed for lockingly retaining an electrical plug mated with a socket to prevent separation therebetween. Some of these devices prevent any displacement between the electrical plug and socket while others primarily prevent disengagement to maintain electrical contact. The primary purpose of these devices is that of preventing disengagement with a secondary benefit of reducing the likelihood of exposed electrically charged prongs.

SUMMARY OF THE INVENTION

A flexible water resistant or impermeable sheath includes opposed openings for inserting and withdrawing an electrical plug and socket unit and attached conductors. The sheath should be impermeable or at least highly resistant to penetration by liquid or particulate contaminants. A closure device is disposed at each end of the sheath to secure the sheath water tight about the respective extending conductor. The flexibility of the sheath permits accommodation of any size or configuration of plug and socket provided only that the width of the sheath is sufficient to wrap therearound. To prevent damages to the sheath due to abrasion, a heavy duty shroud having openable flexed opposed pairs of flaps is positionally attached to envelope the sheath. Closure of the opposed pairs of flaps provides further protection against intrusion of liquid and particulate contaminants. Additionally, the flaps envelop the corresponding ends of the sheath to prevent exposure of the sheath due to relative sliding movement between the sheath and the shroud.

It is therefore a primary object of the present invention to provide a shroud to envelop a water tight flexible sheath for enclosing an in-line electrical connector.

Another object of the present invention is to provide a shroud having closable flap openings for accommodating insertion and withdrawal of a sheath encased electrical unit disposed intermediate a pair of electrical conductors.

Still another object of the present invention is to provide an open ended sheath extending about an electrical plug and electrical socket and having its opposed ends securable to the electrical conductors extending from the electrical plug and socket.

A further object of the present invention is to provide a flexible light weight and inexpensive shroud for protecting in-line electrical conductors against abrasion.

A still further object of the present invention is to provide an inexpensive disposable water tight shroud for various sized in-line electrical conductors.

A yet further object of the present invention is to provide a method for protecting in-line electrical connectors from creating a hazard.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which:

FIG. 1 depicts a perspective view of the sheath;

FIG. 2 is an isometric view of the sheath wrapped about electrical connectors;

FIG. 3 is a representative cross sectional view of a sheath wrapped about electrical connectors;

FIG. 4 is a representative cross sectional view taken along lines 4—4, as shown is FIG. 1;

FIG. 5 is an isometric view of a shroud partially enveloping a closed sheath enclosing a pair of electrical connectors;

FIG. 6 is a representative cross sectional view of the shroud in the closed state, taken along lines 6—6, as shown in FIG. 5;

FIG. 7 is a cross sectional view taken along lines 7—7, as shown is FIG. 5; and

FIG. 8 is a cross sectional view of the shroud only and taken along lines 8—8, as shown in FIG. 7.

DESCRIPTION OF THE PREFERRED EMBODIMENT

Extension cords are often used at construction sites for commercial purposes and by consumers to provide electrical power at a location distant from an electrical socket. Sometimes such cords must be used during inclement weather or in areas having water puddles or damp ground. The presence of water in and about each in-line electrical connector of an electrical extension cord presents an obvious safety hazard to both equipment and personnel.

Referring jointly to FIGS. 1, 2, 3 and 4, a sheath 10 will be described which effectively encapsulates and protects an in-line electrical connector against incursion of fluids and solid contaminants that may give rise to an electrical hazard. The sheath is formed of water tight or water impervious flexible material and serves as a shield to prevent fluid flow therethrough. Sheath 10 is cylindrical in the closed state and of a diameter sufficient to enclose the in-line electrical connector to be protected. A pair of straps 12, 14 are preferably secured to the sheath, by means of cords 16, 18, or the like. In particular, cords 16 or 18 could be configured in the form of an elastomeric band or segment; as described in greater detail herinafter, cord 16 and 18 serve to secure the end of sheath 10 tightly about the in-line electrical connector. Each of the straps preferably includes hook and loop fastening means 20, 22, respectively, which may be of the type sold under the trademark Velcro. Edges 30, 32 include margins 34, 36 stitched to one another by stitches 38, 40. The resulting double thickness provides strength and robustness to the edges of the sheath.

The end of cord 18 is disposed intermediate margins 34, 36 and is preferably stitched in place by stitches 38, 40. Cord 16 is similarly attached between the margins.

In operation, an electrical in-line connector 50 includes a conventional plug 52 mated with a socket 54. Electrical conductors 56, 58 extend in opposed directions from the in-line connector. Prior to mating the plug with the socket, sheath 10 is slipped onto one of the conductors. Thereafter the socket and plug are mated. The sheath is then translated along the in-line connector to position the in-line connector at the approximate midpoint of the sheath, as illustrated in FIGS. 2 and 3. End 42 is bunched or crimped about conductor 56 and cord 16 is wrapped thereabout, to secure the end tightly about the conductor. The cord is preferably is maintained wrapped by encircling it with strap 12 and engaging fastening means 20, 22 with one another. Similarly, end 44 is bunched or crimped about conductor 58 and cord 18 and strap 14 are wrapped thereabout to maintain the end tightly about the conductor. This strap is also maintained in place by engaging fastening means 20, 22 with one another.

To disconnect in-line connector 50, straps 12 and 14 are unfastened from about their respective ends and cords 16, 18 are unwound. Sheath 10 is slid onto one of the conductors to expose the in-line connector. Plug 54 may then be disengaged from socket 52. Sheath 10 may now be slid off the conductor and the respective plug/-socket.

By forming sheath 10 of water resistant or water impervious material, in-line connector 50 is protected from the normally expected water hazards present outdoors. Moreover, it will also protect an in-line connector when used indoors in proximity to damp or water filled basements and other areas where water may be standing or sprayed. Because sheath 10 is preferably formed from a fabric-like material, it may be readily folded or crumpled into a small volume suitable for being carried in the pocket of a workman or within a very small space in the workman's tool chest. Thus, it can be readily carried to and from the work site. The construction of sheath 10 is relatively simple and inexpensive and the material necessary is readily available from many sources; a particularly preferred material comprises what is sometimes referred to as rip stop material or parachute cloth.

Referring to FIG. 5, 6, 7 and 8, there is shown a shroud 60 for enclosing sheath 10 mounted about in-line connector 50 with conductors 56, 58 extending therefrom. The shroud may be formed of two elongated rectangles of flexible yet relatively robust material, such as canvas or the like. The function and purpose of shroud 60 is that of enveloping sheath 10 and serving as a shield against abrasion of the sheath and the enclosed in-line connector. Material other than canvas may be used to form the shroud provided that such material is generally abrasion resistant and unlikely to be torn or ripped by protrusions or abrasive elements present at the point of use.

Shroud 60 may be formed of two mirror image sides 62, 64 joined to one another along the central section of the opposed longitudinal edges. For robustness, side 62 may include folds 66, 68 and side 64 may include folds 70, 72. Folds 66, 70 are placed in facing relationship, as shown in FIG. 7, and stitched together by stitches 74. Similarly, folds 68, 72 are placed adjacent one another and secured in place by stitches 76. Upon such attachment, two pairs of flaps 82, 84 and 86, 88 are developed.

Hook and loop fastening means 92, 94 are disposed about the edges of flaps 82, 84, respectively. Similarly, hook and loop fastening means 96, 98 are disposed along the edges of flaps 86, 88, respectively. Upon placing the flaps of each pair of flaps in juxtaposed relationship with each other, the edges of the mating flaps will become attached to one another. Disengagement is effected by simply pulling the flaps apart from one another. As particularly illustrated in FIG. 6, the noncritical positional mating between the hook and loop fastening means accommodates extension of conductor 56 intermediate the opposing flaps while maintaining the flaps secured to one another. Moreover, variability of the mating permits bulging of shroud 54 to a uniform or a nonuniform degree and of greater or lesser bulging whereby various sized in-line connectors and sheaths may be lodged within the shroud.

In operation, prior to engagement of the plug and socket of an in-line connector, shroud 60 is threaded onto one of the conductors. After sheath 10 is secured about the in-line connector, shroud 60 is slid into an enveloping relationship with the sheath. Thereafter, the edges of the pairs of flaps are pressed against one another to securely retain the in-line connector enveloping sheath within the shroud. The abrasive and tear resistant material of the shroud will provide physical protection for the sheath. The shroud may or may not be water resistant. If not, the water resistant characteristic of sheath 10 will prevent flow of any such water or liquid to the enveloped in-line connector. The shroud may be removed by reversing the installation procedure described above.

Preferably shroud 60 is of bendable compressible material to permit storage within a tool box or similar container having limited space. Thereby, shroud 60, along with sheath 10, may be readily transported by workmen to a work site. Moreover, a plurality of such shrouds and sheaths may be readily stored or transported with minimal space requirements of size and configuration.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles. For example, cords 16 and 18 may suitably comprise any material which can function to secure sheath 10 to the in-line connector, or similar device. Moreover, while cords 16 and 18 have been illustrated as being secured to both sheath 10 and straps 12 or 14, one or both of these attachments may be omitted. These and other modifications in the selection and arrangement of the various components discussed herein may be made without departing from the scope of the invention as expressed in the appended claims.

I claim:

1. Apparatus for protecting an electrical connector having electrical conductors extending therefrom, said apparatus comprising in combination:

a) a sheath of flexible water resistant material for encircling the electrical connector and for accommodating protrusion of the electrical conductors extending from the electrical connector;

b) first means for closing one end of said sheath, said first closing means comprising a cord and a strap and means for securing said strap to itself about the one end of said sheath;

c) second means for closing the other end of said sheath to enclose the electrical connector within said sheath;

d) a shroud of abrasion resistant material for enclosing said sheath while accommodating protrusion of the electrical conductors extending from the electrical connector;

e) third means for closing one end of said shroud; and f) fourth means for closing the other end of said shroud.

2. The apparatus as set forth in claim 1 wherein said second closing means comprises a further cord and a further strap and further means for securing said further strap to itself about the other end of said sheath.

3. The apparatus as set forth in claim 2 wherein each of said securing means and said further securing means comprises hook and loop fastening means.

4. Apparatus for protecting an electrical connector having electrical conductors extending therefrom, said apparatus comprising in combination:

a) a sheath of flexible water resistant material for encircling the electrical connector and for accommodating protrusion of the electrical conductors extending from the electrical connector;

b) first means for closing one ned of said sheath;

c) second means for closing the other end of said sheath to enclose the electrical connector within said sheath;

d) a shroud of abrasion resistant material for enclosing said sheath while accommodating protrusion of the electrical conductors extending from the electrical connector said shroud including opposed ends and wherein each of said ends of said shroud includes a pair of opposed flaps;

e) third means for closing one end of said shroud; and f) fourth means for closing the other end of said shroud.

5. The apparatus as set forth in claim 4 wherein said third closing means includes means for engaging the opposed flaps of the respective one of said pair of flaps with one another.

6. The apparatus as set forth in claim 5 wherein said fourth closing means includes means for engaging the opposed flaps of the respective one of said pair of flaps with one another.

7. A method for protecting an electrical connector having electrical conductors extending therefrom, said method comprising the steps of:

a) encircling the electrical connector with a sheath of flexible water resistant material while accommodating extension of electrical conductors from the electrical connector through respective opposed openings of the sheath;

b) closing one opening of the sheath about the electrical conductor extending therefrom;

c) further closing the other opening of the sheath about the electrical conductor extending therefrom to enclose the electrical connector within the sheath;

d) enclosing the sheath with a shroud of abrasion resistant material while accommodating protrusion of the electrical conductors extending from the electrical connector;

e) yet further closing one end of the shroud about the electrical conductor extending therefrom, said yet further step of closing including the step of attaching a pair of opposed flaps to each other at the one end of the shroud; and f) still further closing the other end of the shroud about the electrical conductor extending therefrom.

8. The apparatus as set forth in claim 7 wherein the still further step of further closing includes the further step of attaching a further pair of opposed flaps to each other at the other end of the shroud.

9. Apparatus for protecting an electrical connector having electrical conductors extending therefrom, said apparatus comprising in combination:

a) a sheath of flexible water resistant material for encircling the electrical connector, said sheath including first and second ends for accommodating protrusion of the electrical conductors extending from the electrical connector;

b) a shroud of abrasion resistant material for enclosing said sheath, said shroud including third and fourth ends for accommodating protrusion of the electrical conductors extending rom the electrical connector, each of said third and fourth ends comprising a pair of opposed flaps; and c) means for closing said third and fourth ends to enclose said sheath while accommodating protrusion of the electrical conductors.

10. The apparatus as set forth in claim 9 wherein said shroud comprises two opposed sides, each of said sides including longitudinal edges and means for securing the central section of each longitudinal edge of one of said sides to the corresponding central section of each longitudinal edge of the other of said sides.

11. The apparatus as set forth in claim 9 including means for attaching the flaps of each pair with one another.

12. The apparatus as set forth in claim 11 wherein said attaching means comprises hook and loop fastening means.

13. A shroud of abrasion resistant material for enclosing an element to be protected, said shroud comprising in combination:

a) a pair of opposed sides, each of said sides including longitudinal edges;

b) means for securing the central sections of each edge of said longitudinal edges of one of said sides with a corresponding central section of an edge of said longitudinal edges of the other of said sides;

c) a first pair of flaps disposed of one end of said shroud and defined by a first pair of ends of said pair of sides;

d) a second pair of flaps disposed at the other end of said shroud and defined by a second pair of ends of said pair of sides;

e) first attachment means for attaching said first pair of flaps to one another; and f) second attachment means for attaching said second pair of flaps to one another.

14. The apparatus as set forth in claim 13 wherein each of said sides is essentially rectangular in planform.

15. The apparatus as set forth in claim 13 wherein said first attachment means comprises hook and loop fastening means.

16. The apparatus as set forth in claim 15 wherein said second attachment means comprises hook and loop fastening means.

17. A shroud for enclosing an element to be protected, said shroud comprising in combination:

a) a central portion for enveloping the element to be protected;

b) a first pair of flaps disposed at one end of said central portion;

c) a second pair of flaps disposed at the other end of said central portion;

d) first means for fastening the flaps of said first pair of flaps with one another; and e) second means for fastening the flaps of said second pair of flaps with one another.

18. The apparatus as set forth in claim 17 wherein said shroud is essentially rectangular in planform prior to envelopment of the element.

19. The apparatus as set forth in claim 17 wherein the element includes an appendage extending in each direction from the element and wherein said first fastening means accommodates protrusion of one of the appendages from said first pair of flaps and said second fastening means accommodates protrusion of the other of the appendages from said second pair of flaps.

20. An apparatus for protecting an in-line electrical connector including electrical conductors comprising:

a sheath of flexible water-resistant material for encircling the electrical connector, said sheath including first and second ends;

a fist closing device fixedly secured to said first end of said sheath for closing said first ned of said sheath, said first closing device comprising a first flexible cord attached to a first strap; and a second closing device fixedly attached to said second end of said sheath for closing said second end of said sheath, said second closing device comprising a second flexible cord and a second strap.

21. The apparatus as set forth in claim 20, wherein said first second straps comprise an elongated flexible strap material and means for securing said strap material to itself.

22. An apparatus for protecting an electrical connector having electrical conductors extending therefrom, said apparatus comprising:

a flexible sheath having a cylindrical configuration, said sheath being positioned to encircle the electrical connector and for accommodating protrusion of the electrical conductors extending from said electrical connector, said sheath having first and second opposing ends;

a first closing device suitably positioned about said first end of said sheath, said device comprising a first strap secured to said sheath by a first flexible connector; and a second closing device suitably configured for placement about said second end of said sheath, said device comprising a second strap secured to said sheath by a second flexible connector.

23. The apparatus as set forth in claim 22, wherein said first and second flexible connectors comprise cords.

* * * * *